US006601481B2

(12) United States Patent
Chuang

(10) Patent No.: US 6,601,481 B2
(45) Date of Patent: Aug. 5, 2003

(54) TOOL KIT HAVING A WRENCH FOR FASTENING TOOL-MOUNTING BOLTS

(76) Inventor: Louis Chuang, 7F-8, No. 20, Ta Lon Road, Taichung (TW)

( * ) Notice: Subject to any disclaimer, the term of this patent is extended or adjusted under 35 U.S.C. 154(b) by 0 days.

(21) Appl. No.: 09/975,462

(22) Filed: Oct. 9, 2001

(65) Prior Publication Data

US 2003/0066396 A1 Apr. 10, 2003

(51) Int. Cl.[7] ..... B25B 23/00
(52) U.S. Cl. ..... 81/440; 81/177.4; 7/168
(58) Field of Search ..... 81/437–440, 177.4, 81/180.1, 184, 490; 7/168

(56) References Cited

U.S. PATENT DOCUMENTS 5,320,004 A * 6/1994 Hsiao ..... 81/177.4
5,450,774 A * 9/1995 Chang ..... 7/168
5,970,828 A * 10/1999 Bondhus et al. ..... 81/440
6,092,444 A * 7/2000 Hsiao ..... 7/168

* cited by examiner

*Primary Examiner*—D. S. Meislin
(74) *Attorney, Agent, or Firm*—Alan D. Kamrath; Rider, Bennett, LLP

(57) ABSTRACT

A tool kit includes a body having at least one compartment, at least one tool-mounting bolt mounted to the body, and at least one set of tools rotatably mounted to the tool-mounting tool. The set of tools is received in the compartment when not in use. A wrench is detachably mounted to the body for adjusting tightness of the tool-mounting bolt.

19 Claims, 8 Drawing Sheets

A – A

TOOL KIT HAVING A WRENCH FOR FASTENING TOOL-MOUNTING BOLTS

BACKGROUND OF THE INVENTION

1. Field of the Invention

The present invention relates to a tool kit of the type having a plurality of tools pivotally mounted around at least one tool-mounting bolt mounted in a body. In particular, the present invention relates to a tool kit having a wrench detachably attached thereto, wherein the wrench can be removed from the body of the tool kit to tighten the loosened tool-mounting bolt.

2. Description of the Related Art

A typical tool kit comprises a body to which at least one tool-mounting bolt is mounted. A plurality of tools are pivotally mounted around the tool-mounting bolt. Thus, the tools are in a storage position when not in use, and a specific tool is pivoted outward to an operative position when required. Such a tool kit is quite convenient to users, particularly cyclists, as many small tools required for repairing bicycles can be incorporated into a single body, which is convenient to use and carriage. Nevertheless, the tool-mounting bolt might be loosened, and the tools will scatter if the tool-mounting bolt is completely disengaged from the body. Thus, inconvenience is caused, as the user must carry a specific wrench for tightening the tool-mounting bolt having a hexagonal groove in an end face thereof for engaging with the specific wrench.

SUMMARY OF THE INVENTION

An object of the present invention is to provide a tool kit having a wrench detachably attached thereto, wherein the wrench can be removed from the body of the tool kit to tighten the loosened tool-mounting bolt.

A tool kit in accordance with the present invention comprises a body comprising at least one compartment, at least one tool-mounting bolt mounted to the body, at least one set of tools rotatably mounted to said at least one tool-mounting bolt, said at least one set of tools being received in said at least one compartment when not in use, and a wrench detachably mounted to the body for adjusting tightness of said at least one tool-mounting bolt. The wrench is not mounted to said at least one tool-mounting bolt and detachable from the body for adjusting tightness of said at least one tool-mounting bolt.

In a preferred embodiment of the invention, a tool kit comprises:

a body comprising two side walls and a separation wall extending between the side walls to thereby divide a space between the side walls into two compartments, each of the side walls having a first end and a second end;

two tool-mounting bolts respectively mounted to the first ends of the side walls and the second ends of the side walls, a set of tools being rotatably mounted to each of the tool-mounting bolts, each said set of tools being received in an associated one of the compartments when not in use; and a wrench detachably mounted to the body, the wrench being not mounted to said at least one tool-mounting bolt, the wrench being detachable from the body for adjusting tightness of the tool-mounting bolts.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
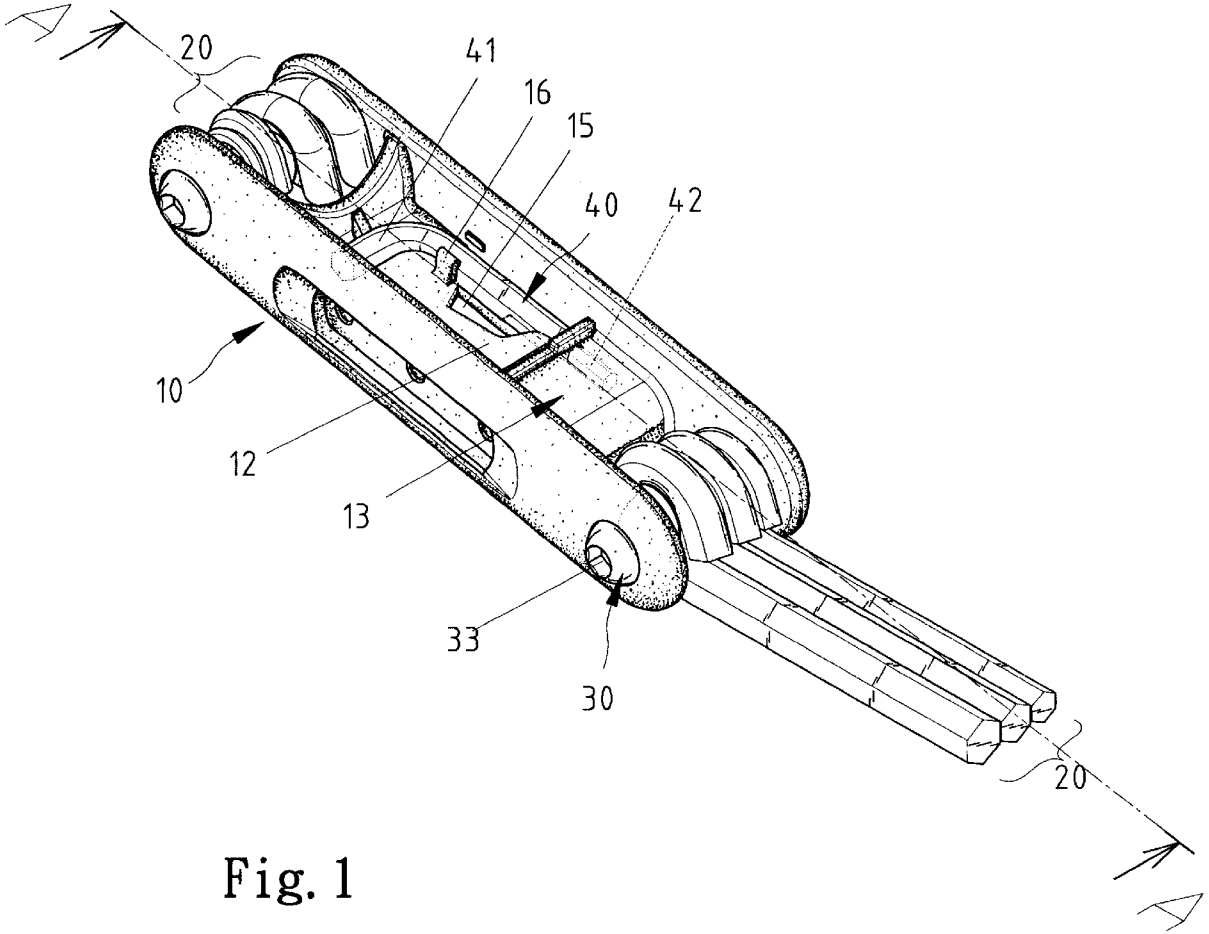
FIG. 1 is a perspective view of a tool kit in accordance with the present invention.
Figure 2:
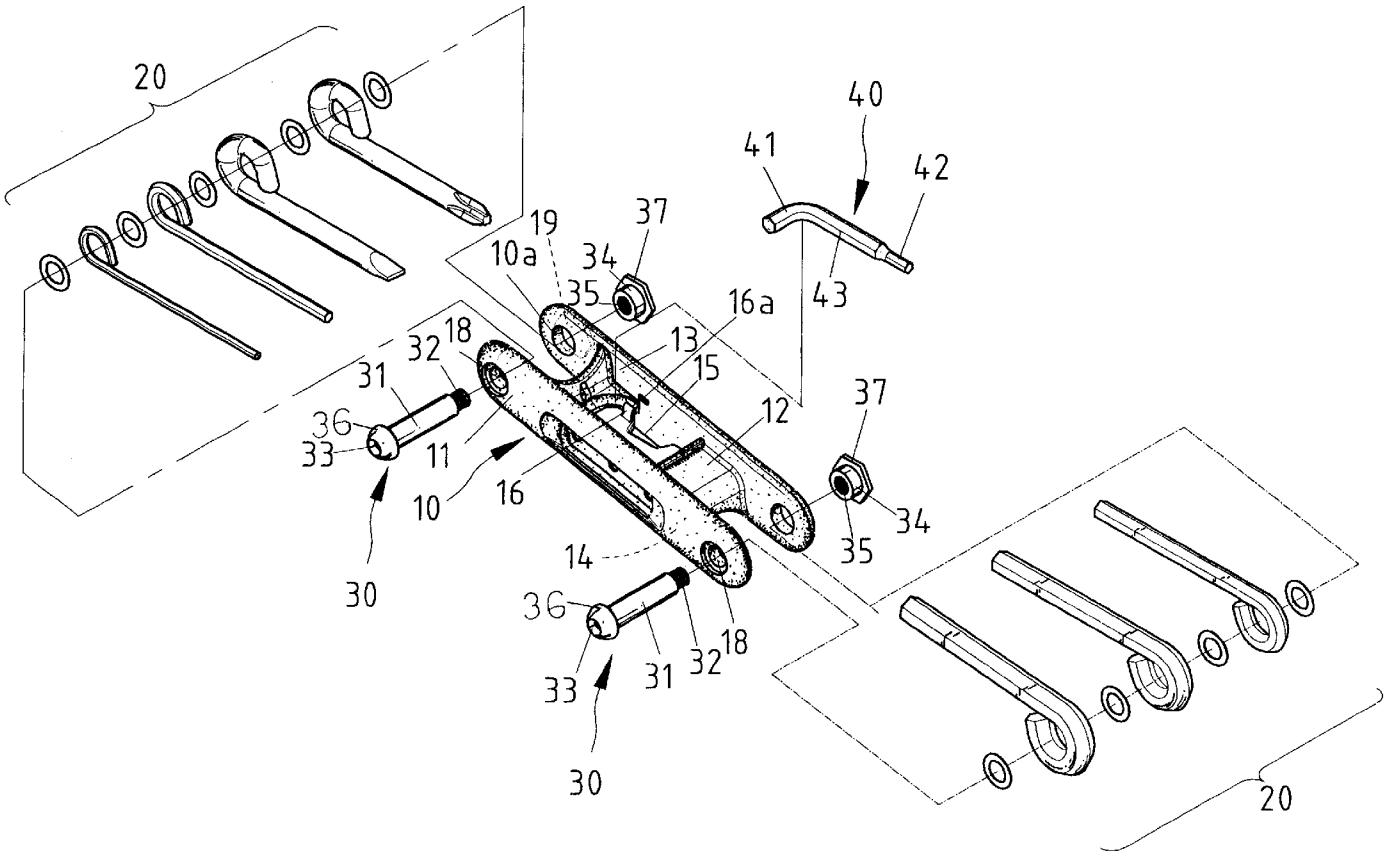
FIG. 2 is an exploded perspective view of the tool kit in accordance with the present invention.
Figure 2A:
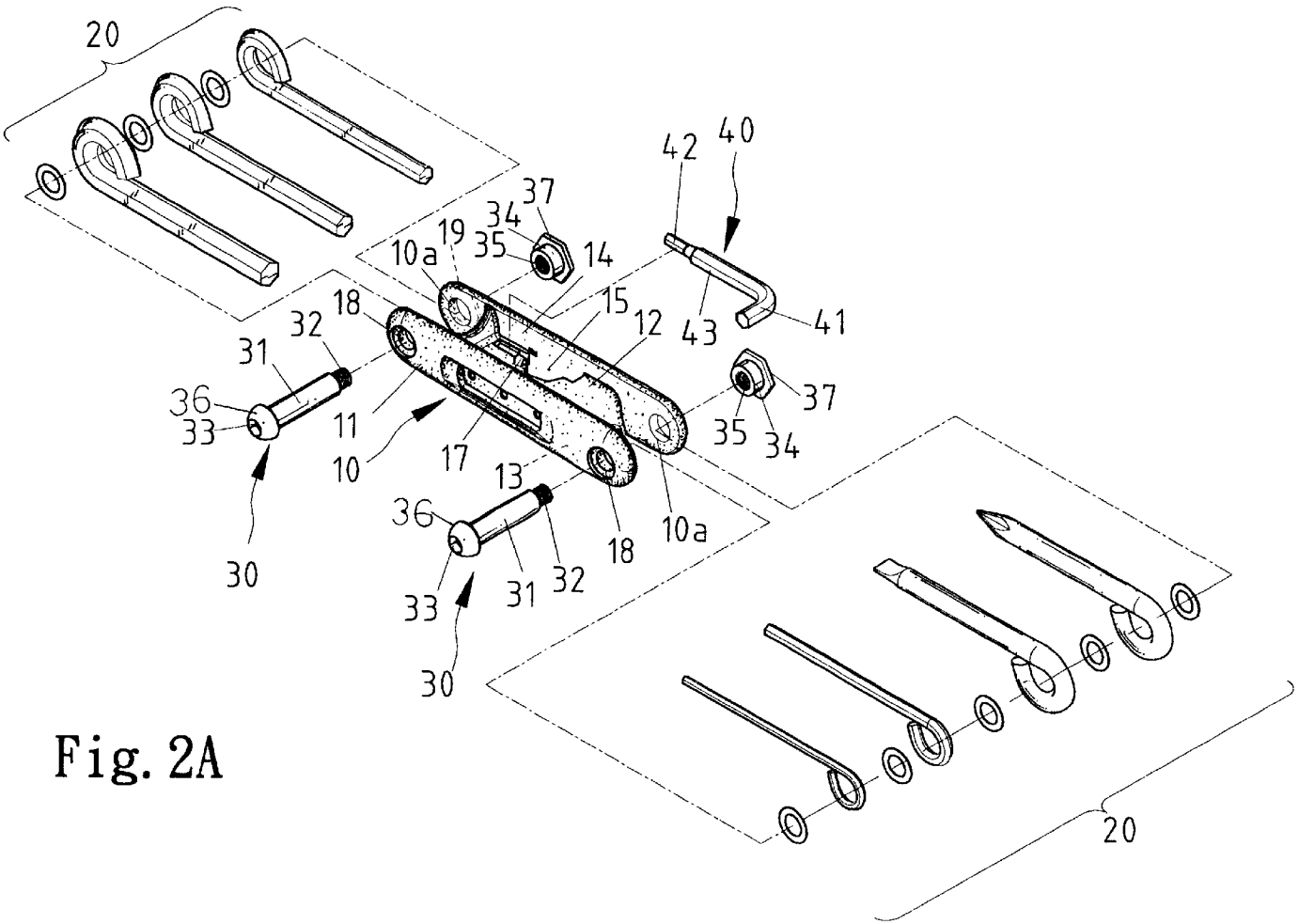
FIG. 2A is an exploded perspective view showing the other side of the tool kit in accordance with the present invention.

Referring to FIGS. 1 and 2, a tool kit in accordance with the present invention generally comprises a body 10 including two preferably parallel side wails 11 and a separation wall 12 extending between the side walls 11 to thereby divide a space between the side walls 11 into a first comportment 13 and a second compartment 14. The separation wall 12 has two opposite sides integrally formed with the side walls 11, two opposite faces and two opposite ends. A slot 15 is defined in the separation wall 12 to communicate the first compartment 13 with the second compartment 14. A first retaining member 16 projects from one of the faces of the separation wall 12 and is located adjacent to an end of the slot 15. A retaining space 16*a* is defined between the first retaining member and on adjacent side wall 11. A second retaining member 17 (FIG. 2A.) projects from the other face of the separation wall 12 and is located adjacent to another end of the slot 15. Another retaining space (not shown) is defined between the second retaining member 17 and the adjacent side wall 11. Preferably, each of the first retaining member 16 and the second retaining member 17 is made of resilient material and has a hooked section on a distal end thereof.

Figure 3:
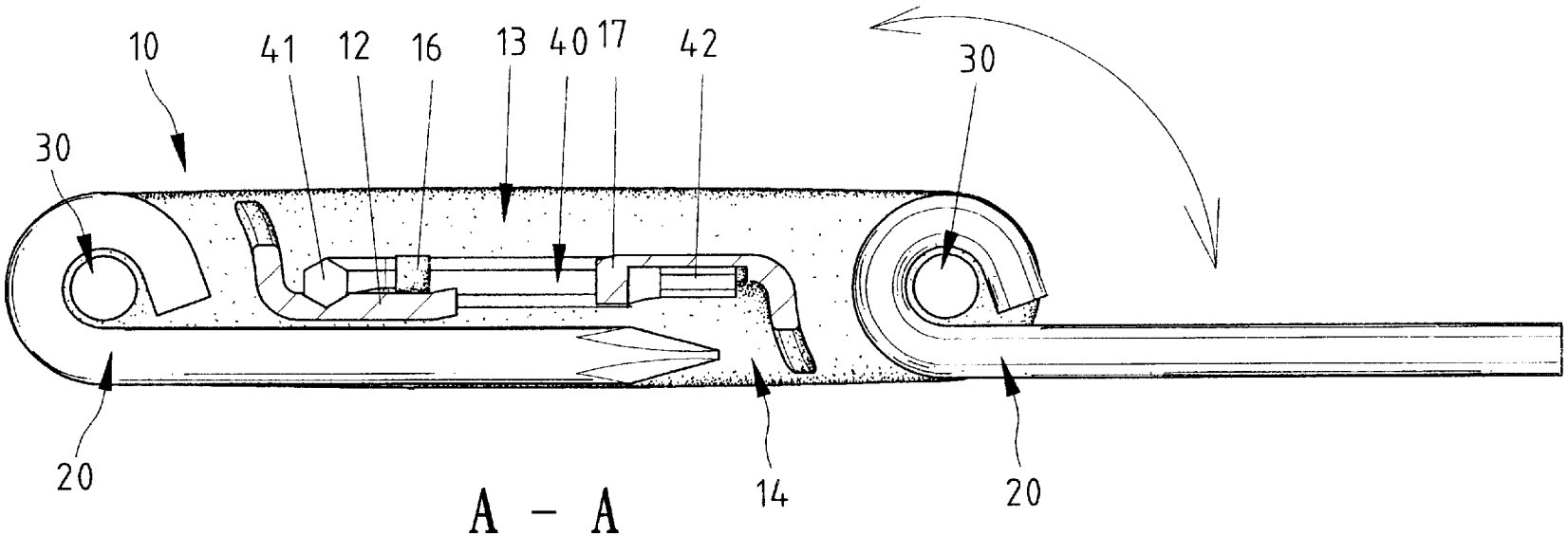
FIG. 3 is a sectional view taken along plane A—A in FIG. 1.

Referring to FIG. 2, first ends of the side walls 11 comprise aligned holes 10*a* and 18 through which a tool-mounting bolt 30 extends. One of the holes 10*a* has a countersink 19 that faces outside for securely receiving a nut 34. In this embodiment, the nut 34 comprises a hexagonal skirt 37 so as to be fitted into the countersink 19. The tool-mounting bolt 30 comprises a stem 31, an enlarged head 36 on an end of the stem 31, and a threaded section 32 on another end of the stem 31. The enlarged head 36 of the tool-mounting bolt 30 has a hexagonal groove 33 defined in an end face thereof. In assembly, the tool-mounting bolt 30 is extended through the holes 10*a* and 18 with the threaded section 32 of the stem 31 being engaged in a screw hole 35 of the nut 34. Pivotally mounted around the tool-mounting bolt 30 are a plurality of tools 20 including Allen wrenches, screwdrivers, etc. Thus, when not in use, the tools 20 can be received in one of the first compartment 13 and the second compartment 14, e.g., compartment 14. Any one of the tools 20 can be pivoted outward to an operative position when required, as shown in FIG. 3. Such an arrangement can be provided on second ends of the side walls 11. Namely, another set of tools 20 is mounted around another tool-mounting bolt 30, in which the tools 20 can be received in the other compartment 13, and any one of the tools 20 can be pivoted outward to an operative position when required.

Figure 4:
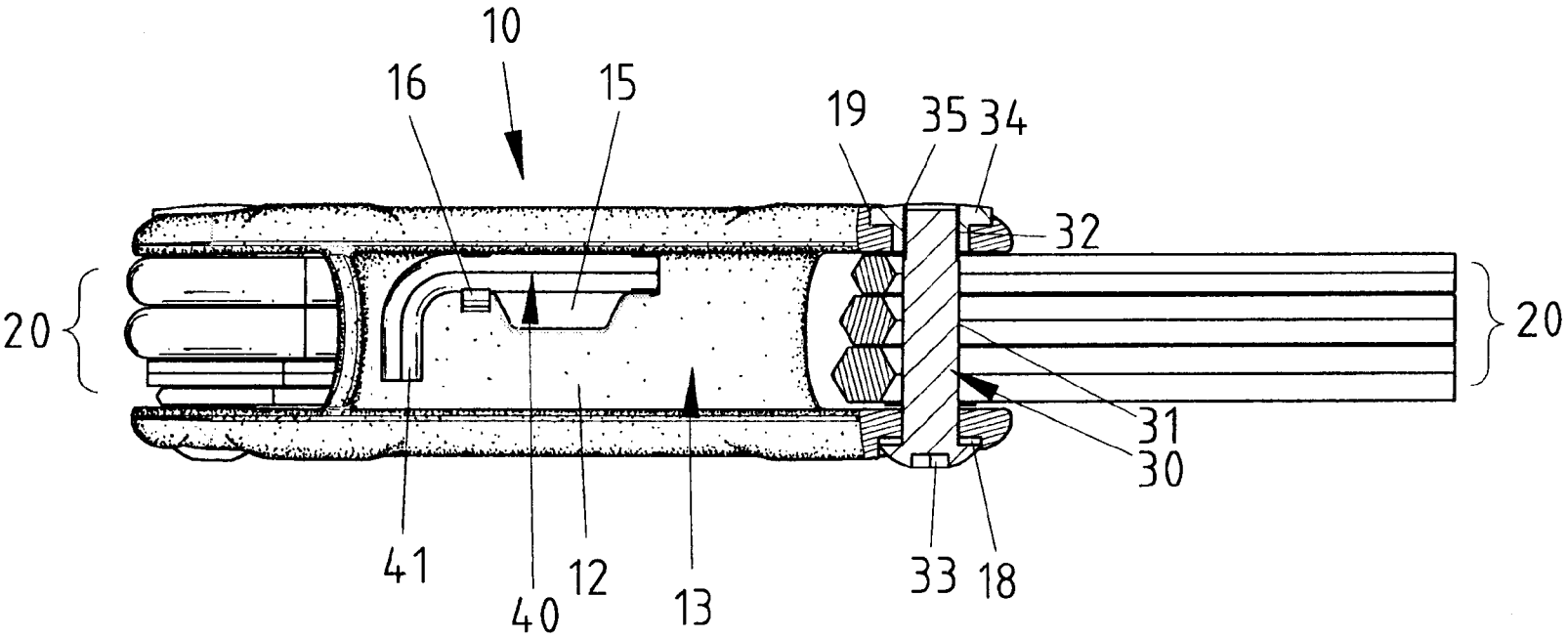
FIG. 4 is a top view of the tool kit.
Figure 5:
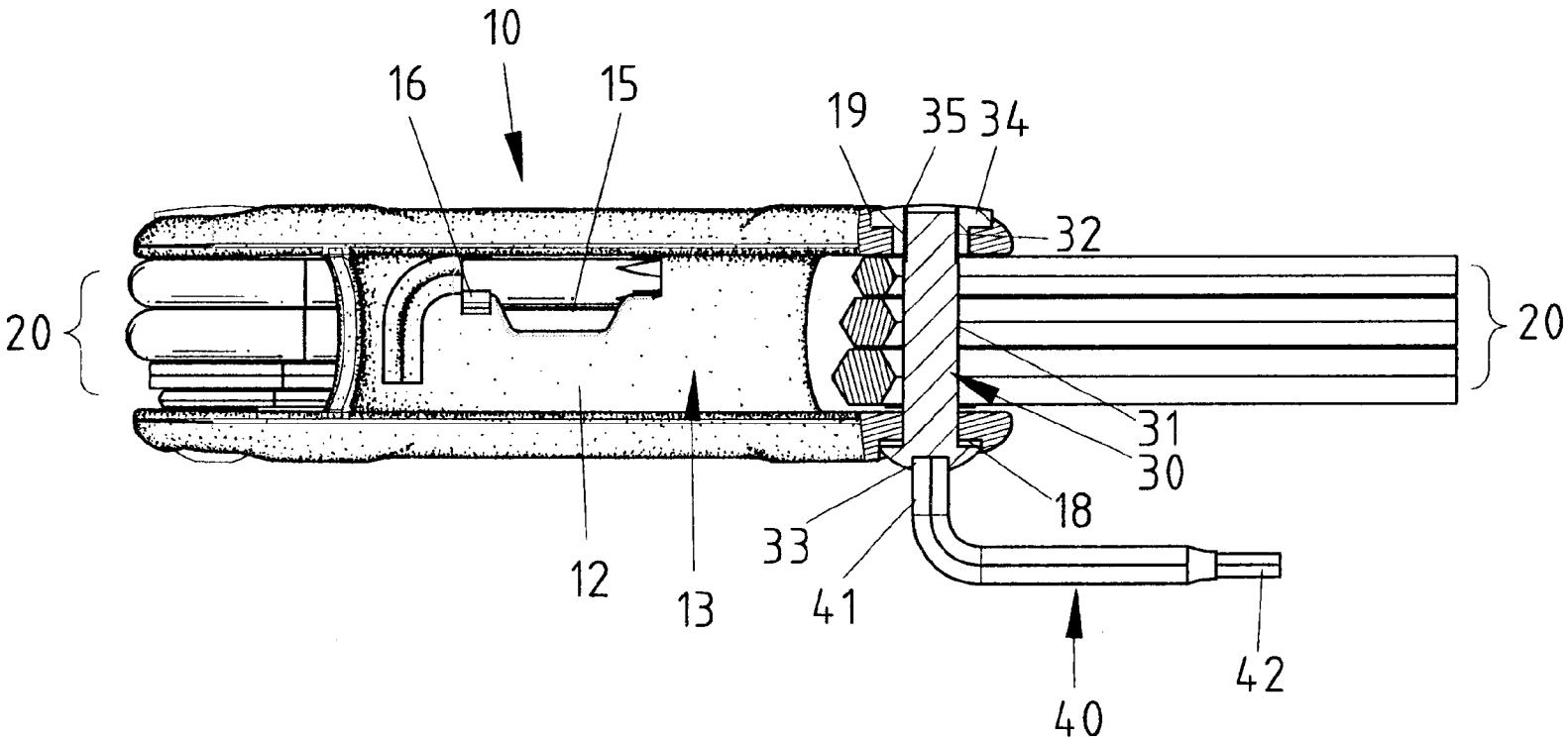
FIG. 5 is a view similar to FIG. 4, illustrating operation of a wrench for tightening a tool-mounting axle.

A wrench 40 for adjusting tightness of the tool-mounting boils 30 is retained in place by the first retaining member 16 and the second retaining member 17. The wrench 40 is substantially L-shaped and comprises a relatively shorter section 41 and a relatively longer section 43. A distal end 42 of the relatively longer section 43 is configured to engage with the hexagonal groove 33 in the end face of the enlarged head 36 of the tool-mounting bolt 30. The separation wall 12 is preferably inclined between the opposite ends; namely, the separation wall 12 extends at an acute angle with a plane extending perpendicularly between the side walls 11 and including both of the tool-mounting bolts 30. As illustrated in FIGS. 1, 3, and 4, the relatively longer section 43 of the L-shaped wrench 10 is inserted through the slot 15 of the separation wall 12 and then turned until the relatively longer section 43 is snapped into and thus held in the retaining space 16*a* between the first retaining member 16 and the adjacent side wall 11 and the retaining space between the second retaining member 17 and the adjacent side wall 11. Specifically, due to the incline of the separation wall 12, the wrench 40 abuts with one of the faces of the separation wall 12 adjustments the retaining space 16*a* and after extending through the slot 15 abuts with the other of the faces of the separation wall 12 adjacent the retaining space defined between the second retaining member 17 and the adjacent side wall 11. The first retaining member 16 and the second retaining member 17 are made of resilient material to allow easy engagement/disengagement of the relatively longer section 43 of the wrench 40 with/from the separation wall 12, and the hooked sections of the first and second retaining members 16 and 17 help positioning of the relatively longer section 43 of the wrench 40. Detachment of the wrench 40 from the body 10 can be easily, quickly achieved by disengaging the wrench 40 from the first and second retaining members 16 and 17 and then moving the wrench 40 out of the slot 15 of the separation wall 12.

The tool-mounting bolt 30 is frequently impinged by the pivotal movements of the tools 20 during use and thus becomes loosened after a period of time. Operation of the tool kit is thus adversely affected. In this case, the user may detach the wrench 40 from the body 10 and engage the distal end 42 of the wrench 40 with the hexagonal groove 33 of the loosened tool-mounting bolt 30 to thereby re-tighten the latter.

Figure 6:
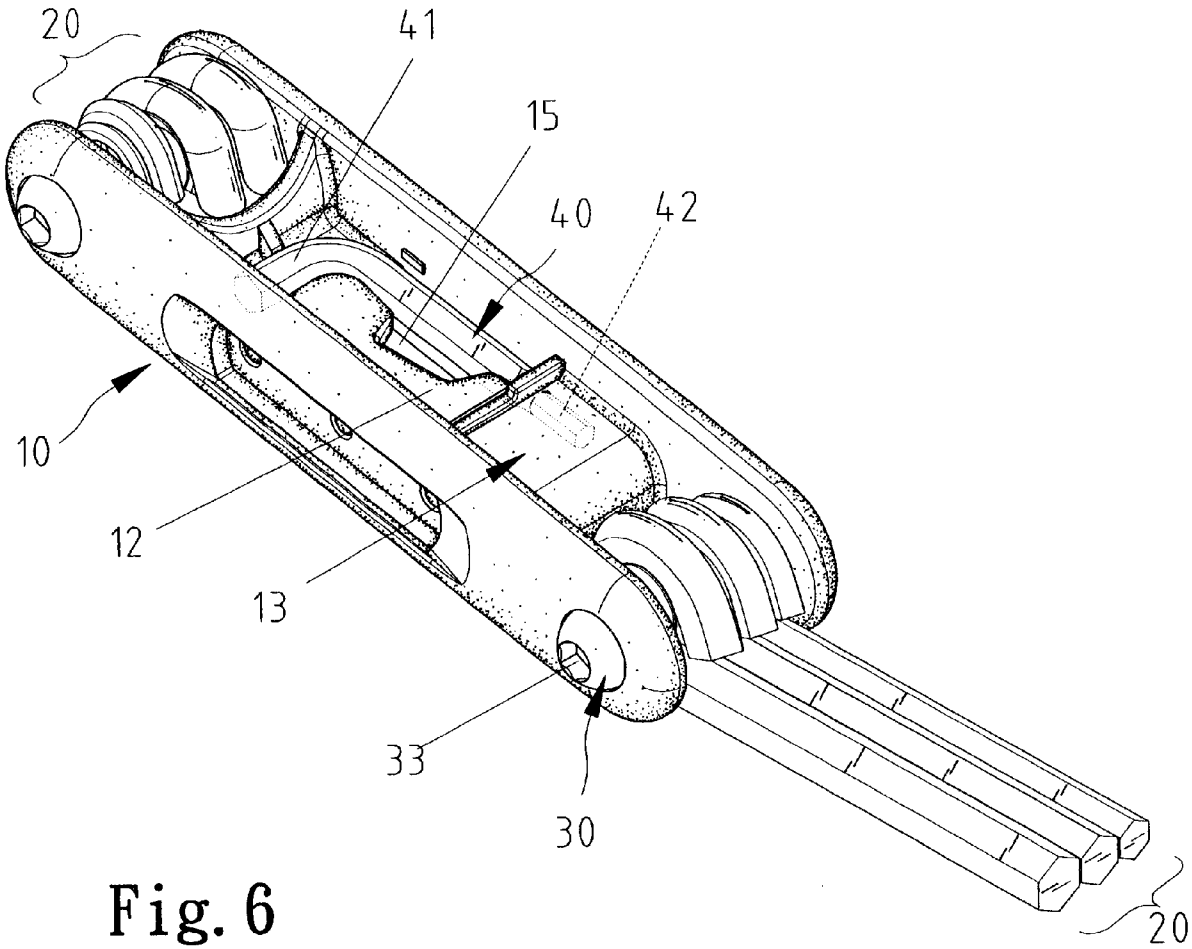
FIG. 6 is a perspective view illustrating a modified embodiment of the tool kit of the invention.
Figure 7:
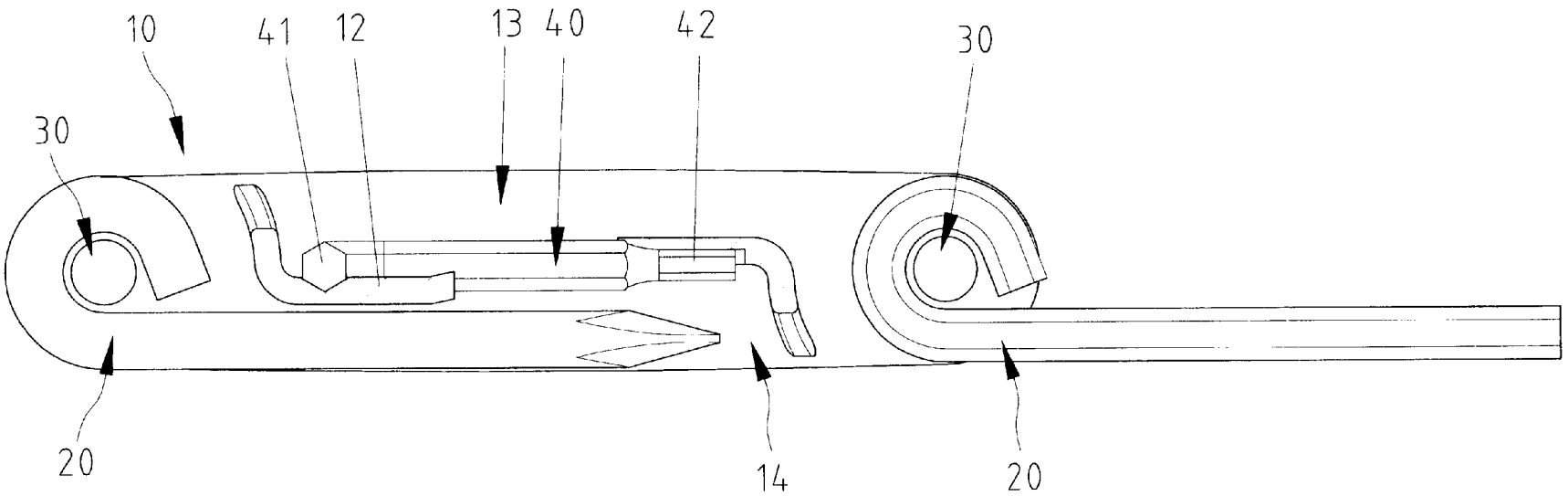
FIG. 7 is a sectional view of the tool kit in FIG. 6.

FIGS. 6 and 7 illustrate a modified embodiment of the invention, wherein the first and second retaining members 16 and 17 are omitted, yet the friction between the surface of the relatively longer section 43 of the wrench 40 and a peripheral wall defining the slot 15 is sufficiently large to retain the wrench 40 in place.

Although the invention has been explained in relation to its preferred embodiment, it is to be understood that many other possible modifications and variations can be made without departing from the scope of the invention as hereinafter claimed.

What is claimed is:

1. A tool kit comprising:

a body comprising at least one compartment;

at least one tool-mounting bolt mounted to the body, with the tool-mounting bolt including a wrench engaging surface;

at least one set of tools rotatably mounted to said at least one tool-mounting bolt, said at least one set of tools being received in said at least one compartment when not in use; and a wrench having an engagement portion for engaging with the wrench engaging surface of the tool-mounting bolt, with the wrench being detachably mounted to the body while the at least one set of tools are mounted to said at least one tool-mounting bolt, with the wrench being detachable from the body for adjusting tightness of said at least one tool-mounting bolt and being mounted to the body for carriage, wherein the body comprises a slot through which a portion of the wrench extends, the portion of the wrench being retained in place by friction between a surface of the portion of the wrench and a peripheral wall defining the slot.

2. The tool kit as claimed in claim 1, with the wrench being detachably mounted to the body independent of said at least one set of tools.

3. A tool kit comprising:

a body comprising at least one compartment;

at least one tool-mounting bolt mounted to the body, with the tool-mounting bolt including a wrench engaging surface;

at least one set of tools rotatably mounted to said at least one tool-mounting bolt, said at least one set of tools being received in said at least one compartment when not in use; and a wrench having an engagement portion for engaging with the wrench engaging surface of the tool-mounting bolt, with the wrench being detachably mounted to the body while the at least one set of tools are mounted to said at least one tool-mounting bolt, with the wrench being detachable from the body for adjusting tightness of said at least one tool-mounting bolt and being mounted to the body for carriage, wherein the body comprises a slot through which a portion of the wrench extends, two retaining members being provided on the body and respectively located adjacent to two ends of the slot, the retaining members releasably holding the portion of the wrench.

4. The tool kit as claimed in claim 3, with the wrench being detachably mounted to the body independent of said at least one set of tools.

5. A tool kit comprising:

a body comprising two side walls and a separation wall extending between the side walls to thereby divide a space between the side walls into two compartments, each of the side walls having a first end and a second end;

two tool-mounting bolts respectively mounted to the first ends of the side walls and the second ends of the side walls, with each of the two tool-mounting bolts including a wrench engaging surface;

a set of tools being rotatably mounted to each of the tool-mounting bolts, each said set of tools being received in an associated one of the compartments when not in use; and a wrench having an engagement portion for engaging with the wrench engaging surface of the tool-mounting bolts, with the wrench being detachably mounted to the body while each set of tools are mounted to the tool-mounting bolt, with the wrench being detachable from the body for adjusting tightness of the tool-mounting bolts and being mounted to the body for carriage.

6. The tool kit as claimed in claim 5, wherein the separation wall comprises a slot through which a portion of the wrench extends, the portion of the wrench being retained in place by friction between a surface of the portion of the wrench and a peripheral wall defining the slot.

7. The tool kit as claimed in claim 5, wherein the separation wall comprises a slot through which a portion of the wrench extends, further comprising at least one retaining member for releasably holding the portion of the wrench.

8. The tool kit as claimed in claim 5, wherein the separation wall comprises a slot through which a portion of the wrench extends, two retaining members being provided on the body and respectively located adjacent to two ends of the slot, the retaining members releasably holding the portion of the wrench.

9. The tool kit as claimed in claim 5, wherein the first ends of the side walls comprises two aligned holes through which an associated one of the tool-mounting bolts extends.

10. The tool kit as claimed in claim 9, wherein one of the aligned holes comprises a countersink, a nut being securely received in the countersink, each of the tool-mounting bolts comprising a threaded section for engaging with the nut.

11. The tool kit as claimed in claim 5, wherein the separation wall is at an acute angle with a plane including the two tool-mounting bolts, with the separation wall comprising opposite faces and a slot extruding between the opposite faces and through which a portion of the wrench extends, with the wrench extending through the slot and engaging the opposite faces of the separation wall.

12. The tool kit as claimed in claim 5, with the wrench being detachably mounted to the body independent of the two tool-mounting bolts.

13. The tool kit as claimed in claim 12, with the wrench being detachably mounted to the body independent of the set of tools mounted to each of the tool-mounting bolts.

14. The tool kit as claimed in claim 5, with the wrench being substantially L-shaped and comprising a relatively longer linear section and a relatively shorter linear section.

15. A tool kit comprising:

a body comprising at least one compartment;

at least one tool-mounting bolt mounted to the body;

at least one set of tools rotatably mounted to said at least one tool-mounting bolt, said at least one set of tools being received in said at least one compartment when not in use;

a wrench detachably mounted to the body for adjusting tightness of said at least one tool-mounting bolt, with the wrench including a portion; and at least one retaining member for releasably holding the portion of the wrench, with the body comprising a slot through which the portion of the wrench extends.

16. The tool kit as claimed in claim 15, with the at least one retaining member being formed on the body independent of the at least one mounting bolt.

17. The tool kit as claimed in claim 15 further comprising another retaining member for releasably holding the portion of the wrench, with the at least one retaining member and the other retaining member respectively located adjacent to two ends of the slot.

18. The tool kit as claimed in claim 17, with the at least one retaining member being formed on the body independent of the at least one mounting bolt.

19. A tool kit comprising:

a body comprising at least one compartment;

at least one tool-mounting bolt mounted to the body;

at least one set of tools rotatably mounted to said at least one tool-mounting bolt, said at least one set of tools being received in said at least one compartment when not in use;

a wrench detachably mounted to the body for adjusting tightness of said at least one tool-mounting bolt, with the wrench including a portion; and at least one retaining member for releasably holding the portion of the wrench, with the wrench being substantially L-shaped and comprising a relatively longer linear section and a relatively shorter linear section.

* * * * *